United States Patent [19]

Gossard et al.

[11] 4,408,471

[45] Oct. 11, 1983

[54] PRESS BRAKE HAVING SPRING-BACK COMPENSATING ADAPTIVE CONTROL

[75] Inventors: David C. Gossard, Watertown, Mass.; John West, Washington, D.C.; Kim A. Stelson, Cambridge, Mass.; Blair Allison, Melrose, Mass.; R. Davis Webb, Jr., Marion, Mass.; David Hardt, Weston, Mass.

[73] Assignee: Massachusetts Institute of Technology, Cambridge, Mass.

[21] Appl. No.: 201,999

[22] Filed: Oct. 29, 1980

[51] Int. Cl.[3] ..... B21D 5/02

[52] U.S. Cl. ..... 72/21; 72/389; 364/476

[58] Field of Search ..... 72/389, 386, 21, 7, 72/8, 441, 22; 364/476

[56] References Cited

U.S. PATENT DOCUMENTS

| | | | |
|---|---|---|---|
| 3,145,756 | 8/1964 | Hill | 153/20 |
| 3,156,287 | 11/1964 | Munro | 153/10 |
| 3,181,331 | 5/1965 | Wishing | 72/215 |
| 3,333,445 | 8/1967 | Mergler | 72/9 |
| 3,352,136 | 11/1967 | Clarke | 72/9 |
| 3,459,018 | 8/1969 | Miller | 72/7 |
| 3,553,990 | 1/1971 | Suding et al. | 72/8 |
| 3,564,883 | 2/1971 | Koors | 72/8 |
| 3,620,066 | 11/1971 | Henkel et al. | 72/362 |
| 3,653,251 | 4/1972 | Coonan | 72/369 |
| 3,713,312 | 1/1973 | Galdabini | 72/10 |
| 3,729,969 | 5/1973 | Gibson et al. | 72/127 |
| 3,777,525 | 12/1973 | Peddinghaus | 72/22 |
| 3,812,694 | 5/1974 | Peddinghaus | 72/21 |
| 3,821,525 | 6/1974 | Eaton et al. | 235/151.1 |
| 3,895,509 | 7/1975 | Peddinghaus | 72/21 |
| 3,955,389 | 5/1976 | Foster | 72/9 |
| 4,148,203 | 4/1979 | Farazandeh | 72/21 |

OTHER PUBLICATIONS

ICAM Integrated Computer Aided Manufacturing, presented at 4th Annual Industry Briefing, Sep. 11, 1979, Southfield, Mich., pp. 503–506.

ICAM Mathematical Modeling of Sheet Metal Formability Indices and Sheet Metal Forming Processes, AFML-TR-79-4168, Nov. 1979, pp. 235–237 by Air Force Materials Laboratory.

*Primary Examiner*—Gene Crosby

*Attorney, Agent, or Firm*—Frost & Jacobs

[57] ABSTRACT

An electronic adaptive control system for use with hydraulic press brakes to provide compensation for material spring back to accurately produce a desired bend angle in the work piece with a single ram stroke. Fixed input parameters associated with the press brake and material properties, together with ram position and force data are continuously input to a digital computer which calculates the precise point of punch penetration necessary to reverse ram movement in order to produce the desired bend angle in the work piece. By using in-process measurements, a significant savings in machine set-up-time can be achieved in order to produce an accurate bend angle in the work piece the first time and every time.

16 Claims, 8 Drawing Figures

PRESS BRAKE HAVING SPRING-BACK COMPENSATING ADAPTIVE CONTROL

SUMMARY OF THE INVENTION

The present invention is directed to a control system for press brakes, and more particularly to an electronic adaptive control system for use with hydraulic press brakes to predict the point of stroke reversal to produce a desired bend angle based upon in-process measurements made during the forming cycle.

A common problem which occurs with conventional press brakes used to bend sheet metal or the like to a predetermined angle is the return or springback of the material to a position somewhat less than the desired bend upon retraction of the punch member from the die. Generally, the terminal punch position is selected manually by an operator so that the stroke of the ram is reversed at a predetermined point to produce the desired angle of bend. Consequently, the selection of the reversal point by the operator is an artful choice to insure that the metal sheet is overbent just enough to spring back to the desired angle. This procedure is usually based on trial and error coupled with the experience of the press brake operator.

The proper point of stroke reversal for a particular bend angle may depend upon the properties of the material, the geometry of the die and punch, and the specific angle desired. This point is often found by making several trial bends to empirically determine the reversal point producing the best bend angle including compensation for springback. However, the reversal point found in this manner usually only holds true for small lot sizes of material due to variations in material properties, and also increases substantially the set-up time for the press thereby decreasing production and increasing the cost of the finished product.

The present invention includes an electronic control system associated with the press brake which senses the position of the ram and the force supplied to the work piece, and processes this information to provide a control signal for activating the ram reversing mechanism at the precise point of punch penetration to accurately produce the desired bend angle in the work piece with a single ram stroke. Since the control system is adaptive based on working parameters of the brake encountered during the forming process, trial and error procedures for establishing the required point of ram reversal are eliminated thereby reducing machine set-up time. Furthermore, the adaptive control system of the present invention may be retrofitted to an existing press brake without modification to the basic brake operating controls.

In a preferred embodiment, the adaptive control of the present invention includes a position encoder for sensing the position of the ram to produce a digital ram position signal. A load transducer in the form of a load cell associated with either or both of the ram hydraulic pistons produces a load signal representative of the instantaneous force supplied to the work piece. Using this information as well as fixed input data relating to the die and brake structure, as well as the particular work piece material, the processor calculates the precise point of ram position necessary to produce a bend having a particular relaxed angle. When the ram reaches the calculated point, the direction of movement of the ram is reversed to bring the punch out of contact with the work piece. Subsequent bends may be made in a similar manner without additional manual set-up of the brake.

Further features of the invention will become apparent from the detailed description which follows.

DETAILED DESCRIPTION

Figure 1:
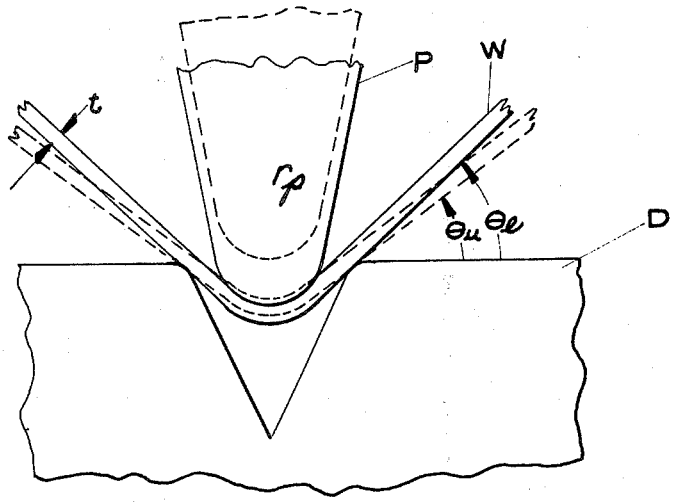
FIG. 1 is a fragmentary enlarged end view illustrating the relative positions of the punch and die during the forming process, with the work piece illustrated in an alternative relaxed position shown in dashed lines.

A typical bending operation illustrating work piece springback in the relaxed state is illustrated in FIG. 1 for a typical die D and punch P. As punch P is moved downwardly by the hydraulically controlled brake ram (not shown), it enters the V-shaped channel of die D, bending work piece W of thickness t to a particular angle. At the furthest downward extent of travel of punch P, work piece W will be bent to the loaded angle $\theta_1$ as illustrated. As the direction of travel of punch P is reversed, work piece W returns to the relaxed position indicated in dashed lines in FIG. 1, and when fully unloaded assumes the unloaded angle $\theta_u$. The amount of "springback" associated with work piece W will depend on the particular characteristics and size of the material used, as well as the parameters of the punch and die. It will be observed that a certain degree of downward over-travel of punch P is necessary to produce a particular desired unloaded angle $\theta_u$. The adaptive control of the present invention provides the necessary amount of punch P over-travel to produce the desired finished bend angle.

Figure 2:
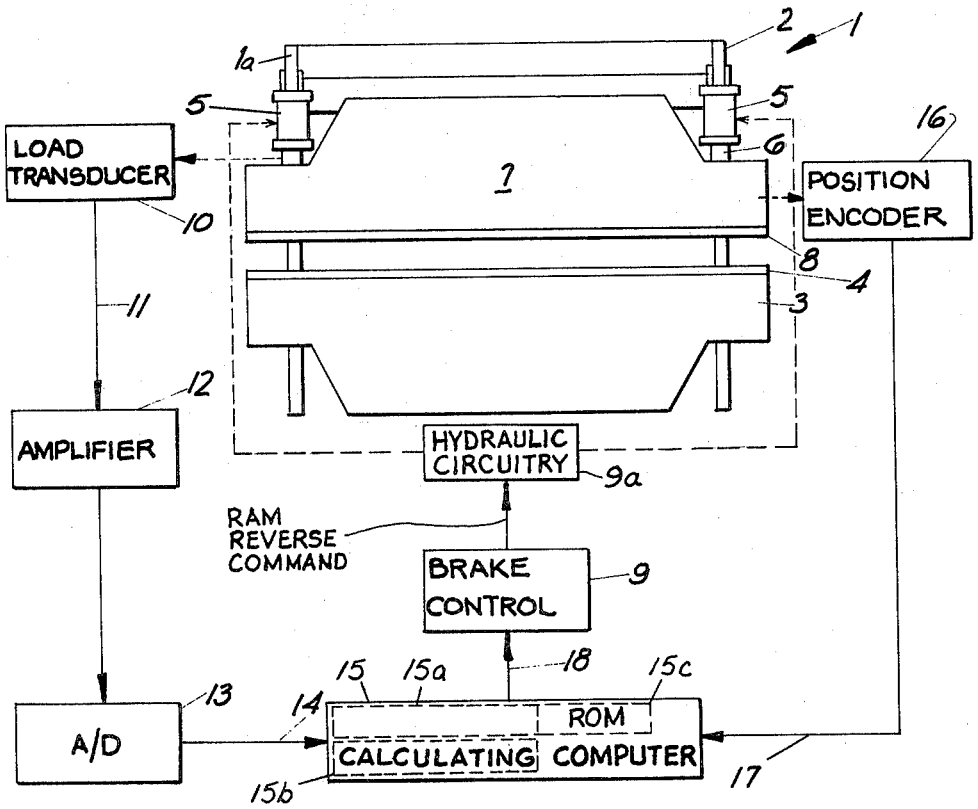
FIG. 2 is a schematic block diagram illustrating the adaptive control system of the present invention.

A general block diagram of the adaptive control of the present invention, illustrated generally at 1, is illustrated in FIG. 2. This arrangement includes a conventional hydraulically operated press brake having a rigid structural frame 2 fixedly mounting a bed 3 supporting a V-die 4 of the type illustrated in FIG. 1, for example.

Frame 2 also mounts a pair of spaced vertically oriented hydraulically operated cylinders 5 operating pistons 6 which are in turn rigidly mounted to ram member 7, which is vertically displaceable with respect to bed 3. The lowermost edge of ram 7 mounts a punch 8 similar in construction and operation to punch P illustrated in FIG. 1.

Also associated with press brake 2 is an electrohydraulic brake control 9 which issues commands to hydraulic circuitry **9*a* associated with hydraulic cylinders 5 for causing ram 7 to move downwardly under control of an electrical ram stroke command, and upwardly under control of a ram reverse command. In the present invention, the downwardly directed ram stroke operates as in a conventional press brake. The hydraulic circuitry 9a including the valving arrangement, the hydraulic cylinders 5 responsive thereto, the means for producing the ram reverse command signal from control 9**, as well as the means for sensing the position of the ram are conventional structures. However, the ram reverse command signal causes reversal of the ram at the precise point calculated by the digital processing means to insure the proper bend angle as will be described in more detail hereinafter.

A conventional load transducer 10 is associated with either or both of piston rods 6 and produces an electrical signal on line 11 proportional to the force being exerted against the work piece. For example, load transducer 10 may comprise a conventional load cell formed from a piece of steel having strain gages arranged at the end of piston 6 to form a conventional bridge circuit as described in U.S. Pat. No. 3,564,883. Hydraulic Press Control, issued Feb. 23, 1971 to C. W. Koors et al.

The electrical signal appearing on line 11 is amplified by amplifier 12, and converted to a digital signal by analog to digital converter 13. The output signal from analog to digital converter 13 is applied on line 14 to processing means formed by digital computer 15. In instances where a load transducer 10 is associated with each of hydraulic pistons 6, amplifier 12 may operate to sum the readings obtained from each transducer to produce an electrical signal proportional to the sum force exerted by ram 7. It will be understood that digital computer 15 may be a conventional general purpose digital computer, a special purpose digital computer, or a microprocessor. As is well known in the art, computer 15 will include random access memory (RAM) and read only memory (ROM) designated generally as memory storage means 15a in FIG. 2. In addition, computer 15 contains the usual calculating means designated generally at 15b.

The instantaneous vertical position of ram 7 is sensed by a conventional position encoder 16 which applies to digital computer 15 on electrical output line 17 a signal representative of the instantaneous position of ram 7.

Utilizing the force and position data received from load transducer 10 and position encoder 16, respectively, digital computer 15 operates as will be described in more detail hereinafter to produce an output signal on line 18 to cause brake control 9 to issue a ram reverse command at the precise point of punch penetration to produce the desired bend angle.

Figure 3A:
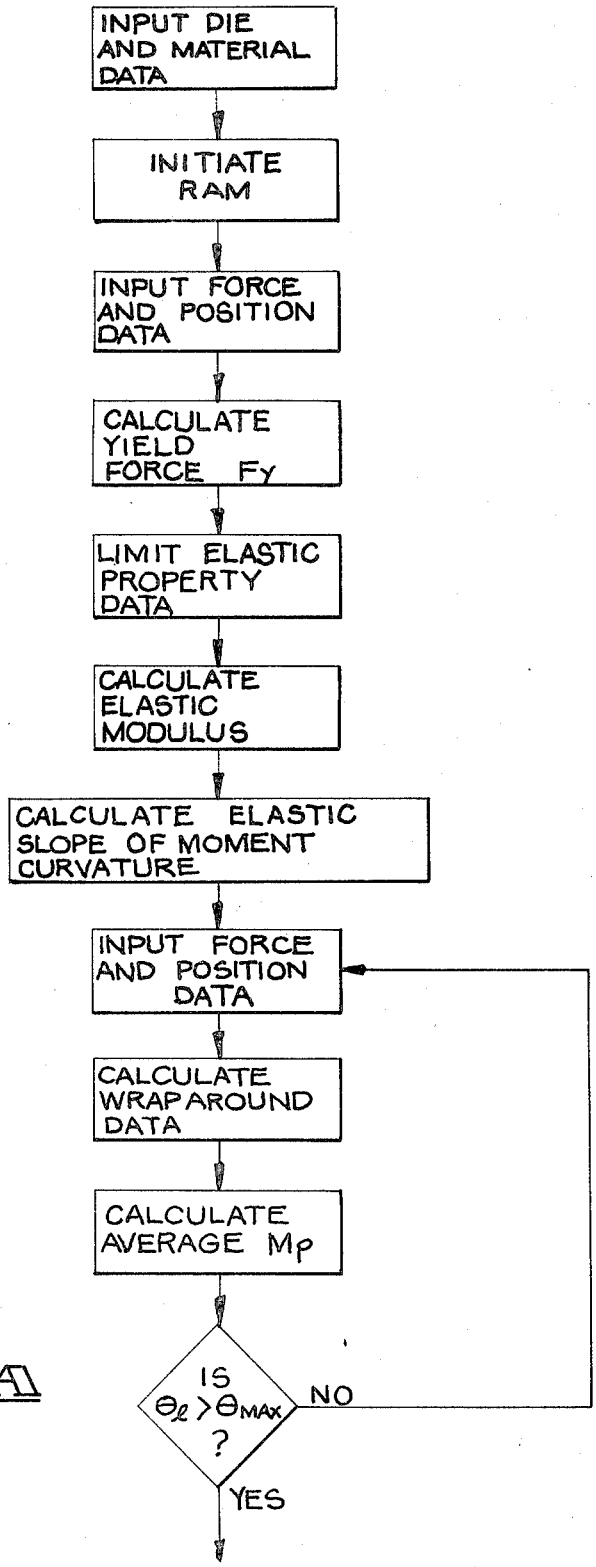
FIG. 3A–FIG. 3B is a flow diagram for the control program of computer 15 used in the adaptive control of the present invention.
Figure 3B:
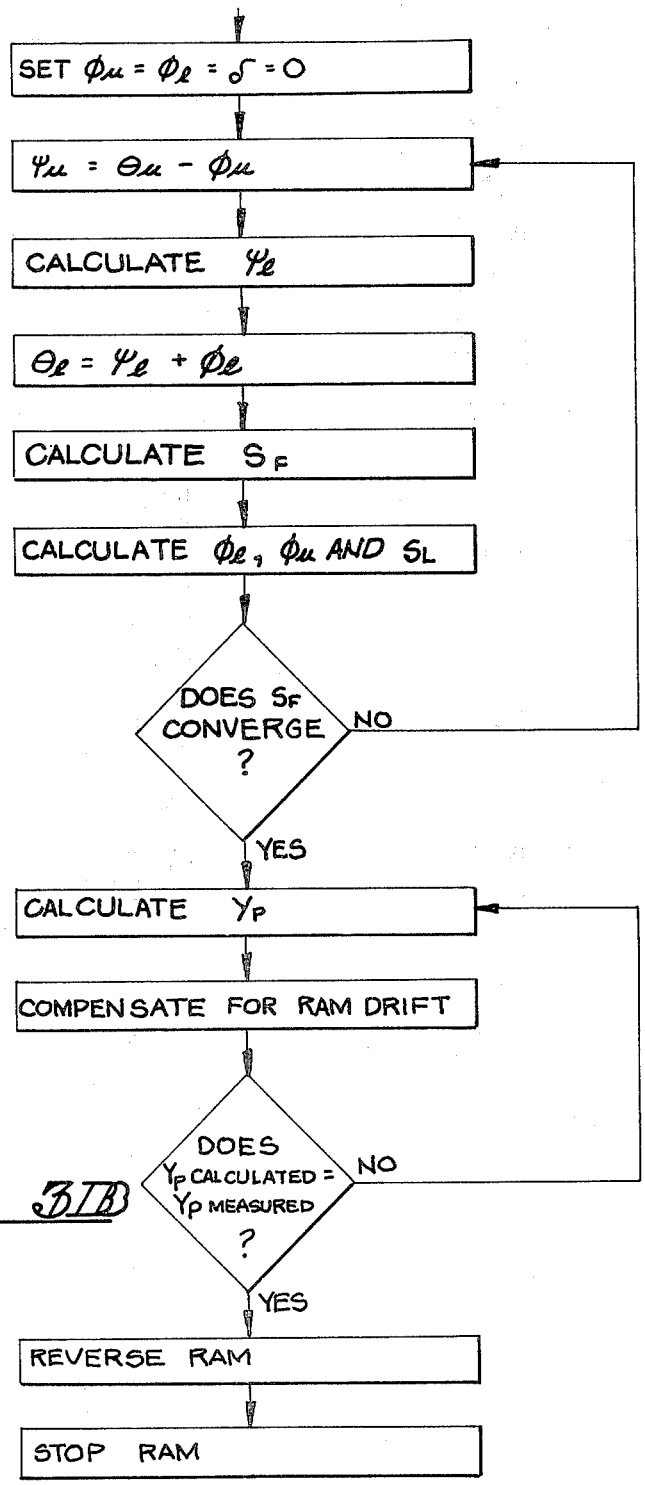
Figure 4:
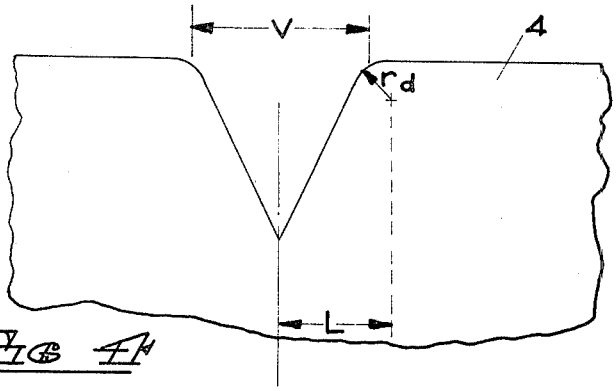
FIG. 4 is a fragmentary end view illustrating the press brake die geometry.

A flow diagram for the control program used with computer 15 in the adaptive control of the present invention is illustrated in FIG. 3A–FIG. 3B. As is well known in the computer processing art, the control program may be implemented as hardware or firmware in a read only memory (ROM) 15c comprising part of memory storage means 15a. Initially, the operator specifies die and sheet geometry, as well as the material properties of the sheet. For purposes of an exemplary showing, a V-die 4 having the parameters illustrated in FIG. 4 is used in the press brake of the present invention. In this configuration, V represents the die width, and $r_d$ represents the die radius. As shown in FIG. 1, $r_p$ defines the punch radius, while the geometry of the sheet W is described by thickness t and width b. The material properties of the sheet are defined by the modulus of elasticity $E_{est}$, the yield stress $\sigma_{yest}$, Poisson's ratio $\nu$, and the coefficient of friction between the sheet and die $\mu$. The values for the material properties need only be approximate since the control program, in effect, adjusts these parameters by inprocess measurements. A value C may also be entered corresponding to the compliance of the press brake. Finally, the desired unloaded angle $\theta_u$ is also entered. It will be understood that in the case of the material properties, for example, the operator may individually input the parameters to the control program, or stored values of material properties may be used by simply specifying the particular material.

With the work piece in place, the operator manually initiates movement of ram 7 downwardly at a relatively constant velocity through brake control 9. When punch 8 is positioned a predetermined distance above die 4, such as one inch, for example, as measured by position encoder 16, force data from load transducer 10 and position information from position encoder 16 are stored as force-displacement pairs by computer 15. The position information may also be corrected to take into account the compliance of the press brake as described hereinbelow.

Figure 5:
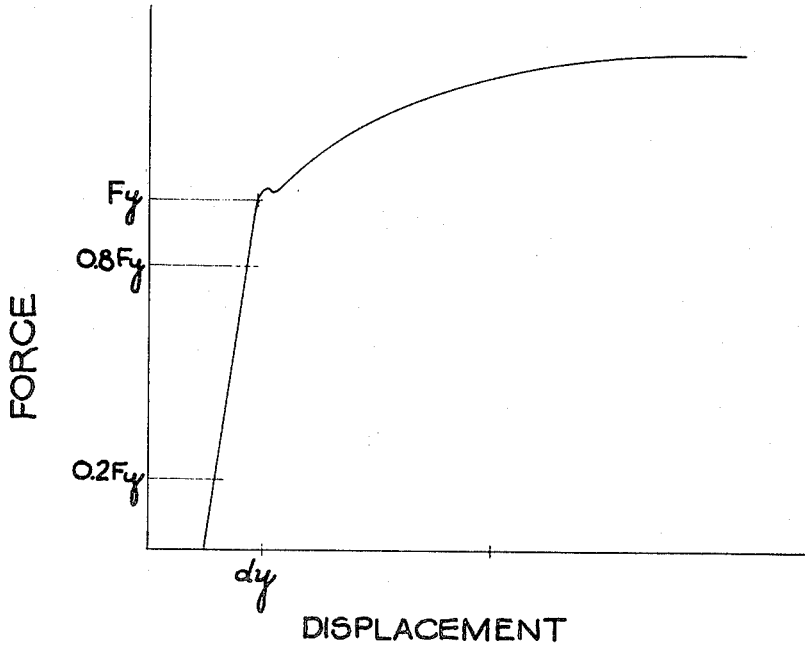
FIG. 5 illustrates graphically the force-displacement relationship in the work piece.

A typical force-displacement curve resulting from the bending operation is illustrated in FIG. 5. In the initial linear or elastic region of the curve depicted in FIG. 5, force-displacement measurements are used to estimate the elastic modulus of the material as well as the point of punch-sheet contact. This information may be used to calculate the point at which yield occurs for yield force $F_y$. The initial beam half-length L (see FIG. 4) is calculated from the die geometry using the following expression:

$$L = \frac{V}{2} + r_d \tan\left[\frac{90^\circ - \frac{\alpha}{2}}{2}\right]$$

The yield force may then be estimated by:

$$F_y(est) = \frac{\sigma_{yest} b t^2}{3L}$$

In order to exclude data occurring in the low force region of the elastic portion of the deformation curve which may be inaccurate due to forces necessary to flatten warped sheets or bottom the dies, as well as data occurring in the upper portion of the elastic region near the yield point, the elastic property data is limited to the region between approximately 20% and 80% of the yield force as illustrated in FIG. 5. It will be understood, however, that other limits defining the range of elastic deformation may also be used.

Measurements with force values between these limits may then be used to determine the elastic modulus. In a preferred embodiment, a least-squares linear fit of the force-displacement plot is used to determine the slope m of the force-displacement plot in the elastic region. This value may be used to provide an estimate of the elastic modulus by:

$$E(\text{measured}) = \frac{2m}{b}\left(\frac{L}{t}\right)^3 (1 - \nu^2)$$

which is related to the slope of the moment-curvature diagram by $$\frac{\partial M_e}{\partial k} = \frac{E(\text{measured})\, I}{1 - \nu^2} = \frac{ML^3}{6}$$

At a point in the forming process, the work piece sheet W will begin conforming or "wrapping around" punch 8. This "wraparound" region is assumed to occur when ram 8 has moved approximately five times the distance from sheet contact to the yield displacement $d_y$ associated with the yield point as illustrated in FIG. 5. This approximation avoids calculation problems which may occur near the yield transition point.

For purposes of the control program of the present invention, it is assumed that the sheet is bending in a circular manner around punch 8, and is substantially straight between the punch and the contact areas of die 4, as illustrated in FIG. 1. Using this straight-circular approximation, the moment in the sheet W under punch 8 and the estimated punch penetration may be estimated by the following relationships:

$$M_p = \frac{F_p (L - R \sin\theta)}{2\cos\theta\,(\cos\theta + \mu \sin\theta)}, \text{ where}$$

$$Y_p = R(1 - \cos\theta) + \frac{\sin\theta\,(L - R\sin\theta)}{\cos\theta}$$

$$R = r_p + r_d + t$$

$$\theta = \sin^{-1}\frac{R}{L}\cos\left[\tan^{-1}\left(-\frac{R - Y_p}{L}\right)\right] + \tan^{-1}\left(-\frac{R - Y_p}{L}\right)$$

and $F_p$ and $Y_p$ represent the total punch force and actual punch position, respectively. In general, the punch moment will be calculated at a number of points with the average used as the estimated moment $M_p$ in order to eliminate noise.

Using the relationship set forth above, the average punch moment $M_p$ continues to be calculated until the loaded flank angle $\theta_1$, as estimated by the control program, is within some predetermined range, for example 20°, of the desired unloaded flank angle $\theta_u$. For example, defining $\theta_{max} = \theta_u - 20°$, as long as $\theta_1 < \theta_{max}$, the control program continues to loop to calculate the average value of $M_p$. However, when the condition $\theta_1 > \theta_{max}$ occurs, the control program branches positive to commence calculations for determining the specific point of ram reversal. The situation is shown in FIG. 3A–FIG. 3B.

Figure 6:
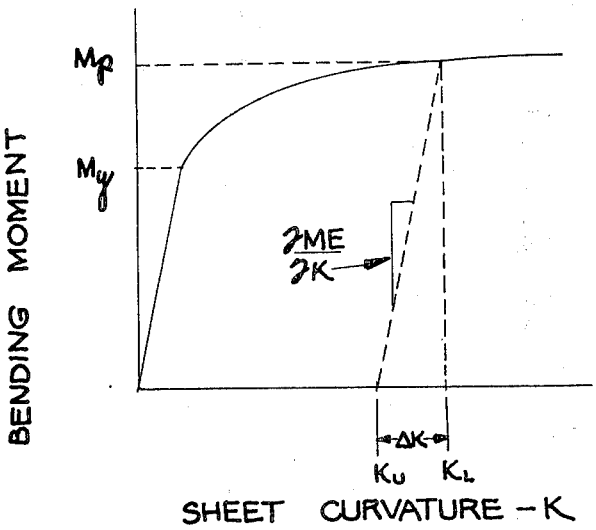
FIG. 6 illustrates graphically the bending moment-sheet curvature relationship in the work piece.
Figure 7:
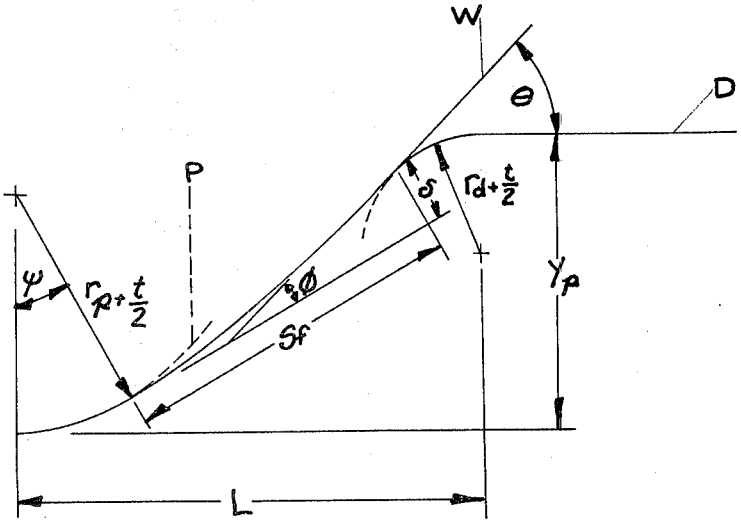
FIG. 7 illustrates diagrammatically the geometric relationships associated with the punch work piece and die in the wraparound region.

In order to accurately determine the predicted unloaded flank angle $\theta_u$, when the spring back of the free portion of sheet W is considerable, the moment arm of the normal die force acting on the sheet and the punch penetration may be calculated from the following using the geometric relationship shown in FIG. 7:

$$S_f = L - \frac{\left(r_p + \frac{t}{2}\right)\sin\psi - \left(r_d + \frac{t}{2}\right)\sin\theta + \delta\sin\psi}{\cos\psi}$$

$$Y_p = r_p + \frac{t}{2}(1 - \cos\psi) + S_F \sin\psi + \delta\cos\psi + \left(r_d + \frac{t}{2}\right)(1 - \cos\theta)$$

where $\psi$ is the angle of wraparound of the sheet W. As noted, since springback of the free portion of the sheet is considerable, the straight-circular assumption where $\phi = \delta = 0$ and $\psi = \theta$, can no longer be used. The springback of the punch portion can be calculated from the moment-curvature diagram illustrated in FIG. 6 which relates bending moment M, which is a characteristic of the geometry and material to the sheet curvature, K. Since the unloading is elastic, and the arc-length is the same in the loaded and unloaded states, the loaded angle can be found from the relationship $$\psi_1 = \psi_u \frac{K_1}{K_1 - \Delta K}$$

Several models are possible for defining the loaded and unloaded shape of the free portion of the sheet not in contact with the die to determine the loaded and unloaded angles and displacements by assuming a rigid (straight) beam, an elastic beam, an elastic perfectly plastic beam or other model. Choosing for example, the elastic perfectly plastic model, the loaded and unloaded angle $\phi_1$ and $\phi_u$, respectively, and the loaded and unloaded displacements $\delta_1$ and $\delta_u$ may be calculated from the following relationships:

$$\phi_1 = \frac{2}{3}\,\frac{M_p S_f}{(\partial M/\partial K)} \qquad \phi_u = \frac{1}{6}\,\frac{M_p S_f}{(\partial M/\partial K)}$$

$$\delta_1 = \frac{40}{81}\,\frac{M_p S_f^2}{(\partial M/\partial K)} \qquad \delta_u = \frac{13}{81}\,\frac{M_p S_f^2}{(\partial M/\partial K)}$$

Specifically as set forth in FIG. 3A–FIG. 3B, $\phi_u$, $\phi 1$, and $\delta$ are set equal to zero to begin the iteration with a straight-circular shape assumption. The unloaded angle of bend may then be calculated as the difference between $\theta_u$ and $\phi_u$. The loaded angle of bend may then be calculated as indicated hereinabove, and used to calculate the predicted finished bend angle. Using these relationships, the free portion of sheet $S_f$ may be calculated, and tested for convergence. The iteration continues until $S_f$ is found to converge within desired limits, whereupon the value of punch penetration of position may be calculated.

When the value of punch position measured by position encoder 16 reaches the precise position estimated by $Y_p$ to produce the desired bend angle, computer 15 produces a signal on line 18 to cause brake control 9 to issue the ram reverse command to the press brake. The ram 7 will then begin moving upwardly, and stop at a predetermined position where punch 8 is out of contact with the work piece sheet W.

In some instances, it may be necessary to correct the actual position data produced by position encoder 16 to take into account the compliance of the press brake. In general, the compliance C will be constant for a given machine or a machine design and may be provided as an input to the initial data by the operator as described above, or stored in a look-up table. For example, in situations where compliance is dependent on load, the actual or corrected punch penetration $Y_p$ may by found from $Y_p$ act $= Y_p$ measured $- CF_p$.

It may also be found that ram 7 may continue to move downwardly for a short period of time after the ram reverse command is given. Compensation may be added for the ram drift by means of a fixed input parameter in the input data to the control program, or a look-up table correlating drift time or distance with the actual force exerted by the press brake ram, which will generally be invariable for a particular machine.

It will be observed that the adaptive control of the present invention provides accurate control of the ram position to activate the ram reverse at the precise point of punch penetration to accurately produce the desired bend angle in the work piece with a single ram stroke. Consequently, trial and error procedures for establishing the required point of ram reversal or itterative procedures where the work piece is successively bent and relaxed are completely eliminated. This results in significant savings in machine set-up time where an accurate bend angle in the work piece may be produced the first time and every time.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In a press brake for bending metal sheet and the like of the type having a frame supporting a bed, a die member mounted on the bed, a ram displaceable with respect to said bed, a punch member mounted on the ram and configured to engage the die member, means for moving said ram toward said bed and reversing means for moving said ram away from said bed, the improvement in combination therewith comprising adaptive control means for compensating for material springback to accurately produce a desired bend angle in the sheet with a single ram stroke, said control means comprising means for sensing the position of the ram to produce a ram position signal, means for sensing the force supplied to the ram to produce a load signal, and digital data processing means responsive to said position and load signals for determining the precise point of punch penetration at which to activate said reversing means to cause ram reversal to produce the desired bend angle.

2. The apparatus according to claim 1 wherein said press brake includes a pair of spaced hydraulically operated pistons connected to said ram and responsive to said ram moving and reversing means for moving said ram toward and away from said bed.

3. The apparatus according to claim 2 wherein said force sensing means comprises a load transducer associated with each of said pistons to produce an electrical signal representative of the force exerted on the associated piston and means for summing said force signals to produce said load signal.

4. The apparatus according to claim 1 including means associated with said position sensing means for modifying the sensed position of said ram in accordance with the compliance of said press brake.

5. The apparatus according to claim 1 wherein said digital data processing means includes memory means for storing input parameters associated with die, punch and sheet material geometry and properties, and means for storing said position and load signals as force-displacement pair data.

6. The apparatus according to claim 5 wherein said digital data processing means includes means for calculating the elastic modulus of the sheet and means for calculating the estimated yield point of the material from said stored parameters and data.

7. The apparatus according to claim 6 wherein said digital data processing means includes means for estimating a wraparound region of sheet bending.

8. The apparatus according to claim 7 wherein said digital data processing means includes means for calculating the values of bending moment and punch penetration within said wrap around region.

9. The apparatus according to claim 8 wherein said digital data processing means includes means for calculating said precise point of punch reversal from said punch penetration value, and means for comparing said calculated point of punch reversal with said ram position signal.

10. The apparatus according to claim 9 wherein said digital data processing means includes means for compensating for ram drift.

11. A method for use with a press brake of the type for bending metal sheets and the like and having a frame supporting a bed, a die member mounted on the bed, a ram displaceable with respect to the bed, a punch member configured to engage the die member mounted on the ram, means for moving the ram toward the bed in a bending stroke and means for moving the ram away from the bed in a reversing stroke, said method compensating for material springback to accurately provide a desired bend angle in the work piece with a single ram bending stroke, said method comprising the steps of:

a. storing input data representative of die, punch and work piece material and geometry;
b. continuously moving said punch toward said die with the work piece in place;
c. continuously sensing the position of said punch with respect to said die to produce punch position data;
d. continuously sensing the force exerted by said punch against the work piece to produce load data;
e. automatically determining from said input, punch position and load data the precise point of punch penetration necessary to accurately produce said desired bend angle; and
f. reversing the direction of travel of said punch away from said work piece when said point of punch penetration is attained.

12. The method according to claim 11 wherein said punch is moved toward said die at a relatively constant velocity.

13. The method according to claim 11 wherein said press brake is of the type having a pair of spaced hydraulically operated pistons connected to an operatively moving said ram, and said force sensing step comprises averaging together the forces exerted by each of said pistons to produce said load data.

14. The method according to claim 11 including the step of correcting said punch position data for machine compliance.

15. The method according to claim 11 wherein said point of punch penetration is determined by:

a. calculating the elastic modulus and estimated yield point of the work piece;
b. calculating from the estimated yield point the region of wraparound sheet bending;
c. calculating the values of bending moment and punch penetration within said wraparound region;

d. calculating said precise point of punch reversal from said punch penetrating value; and e. comparing the calculated point of punch reversal to the actual position of punch penetration.

16. The method according to claim 11 including the step of correcting said precise point of punch reversal for ram drift.

* * * * *